United States Patent [19]

Fu

[11] Patent Number: 4,858,591

[45] Date of Patent: Aug. 22, 1989

[54] KITCHEN SMOKE EXHAUST DEVICE

[76] Inventor: Chuen-Fong Fu, No. 13, Lane 685, Fong Lin Rd. Sec. 3, Lin Yuan Hsiang, Kaohsiung, Taiwan

[21] Appl. No.: 243,459

[22] Filed: Sep. 12, 1988

[51] Int. Cl.[4] ..... F24C 15/20

[52] U.S. Cl. ..... 126/299 D; 126/303

[58] Field of Search ..... 126/299 R, 299 D, 299 E, 126/300–303, 312, 21 R, 21 A; 98/115.1, 115.3; 55/DIG. 36

[56] References Cited

U.S. PATENT DOCUMENTS

| | | | |
|---|---|---|---|
| 204,819 | 6/1878 | Harding | 126/299 D |
| 286,643 | 10/1883 | Schwibinger | 126/301 |
| 1,375,548 | 4/1921 | Barnes | 126/299 D |
| 1,477,590 | 12/1923 | Powell | 126/299 D |
| 2,582,884 | 1/1952 | Nicol | 126/299 D |

FOREIGN PATENT DOCUMENTS

| | | | |
|---|---|---|---|
| 52726 | 3/1982 | Japan | 126/300 |

*Primary Examiner*—James C. Yeung

*Attorney, Agent, or Firm*—Lahive & Cockfield

[57] ABSTRACT

An exhaust device having a cover member which can be put directly on a cooking unit or in a position near the cooking unit. The cover member is provided with a top opening communicated with a fan unit through a connecting tube means which has a telescopic tube section for adjusting the height of the cover and a rotatable section to permit the connecting tube to move laterally. The exhaust device is effective for smoke-exhaustion, thereby saving the energy consumption.

6 Claims, 3 Drawing Sheets

KITCHEN SMOKE EXHAUST DEVICE

BACKGROUND OF THE INVENTION

This invention relates to a smoke exhaust device used for exhausting the smoke produced from a cooking unit or the like, particularly to an exhaust fan device having a cover member which can be lowered to a level adjacent to a cooking unit and an adjustable tube means connecting the cover member to a fan unit.

Conventional kitchen exhaust devices are generally of the type which has a cover means adapted to be placed at a height remote from a stove so that suction ports provided in the cover can not accomplish an efficient suction of the smoke. A common practice to improve the suction effect of a conventional exhaust device is to use a motor having a higher power capacity, thereby consuming a great amount of energy. The remote or high cover also causes a problem in that the spreading smoke cannot be directed effectively to the suction ports. Therefore, a substantial amount of the smoke, including oily residues, remains in the kitchen, dirtying the kitchen walls, utensiles and the like.

SUMMARY OF THE INVENTION

An object of the invention is to provide an improved kitchen exhaust device which can alleviate the above mentioned disadvantages.

The present invention provides a kitchen exhaust device which comprises: a fan unit to be mounted on a wall, having a fan casing with a suction side and a discharging side, and guide conduit provided at the suction side; a cover means to lie above a cooking unit, having a top opening and a top tube extending from the top opening; and a connecting tube means having a first end communicated with the top tube of the cover means and a second end communicated with the guide conduit, the tube means having a bent section connected to the guide conduit, a telescopic section extending downward from the bent section and connecting with the cover for adjusting the level of the cover above the stove, a locking means for locking the telescopic section after adjustment, and a rotatable joint member for permitting the telescopic section to move laterally.

In one aspect of the invention, the exhaust device may further comprise means for collecting oily substances, the means being removably placed in the top tube of the cover, the means including a first insert tube in the top tube, which has a threaded enlarged lower end fitted snugly in the top tube adjacent to the top opening, and a second insert tube placed in the top tube around the first insert tube and having a threaded end to engage with the threaded enlarged lower end of the first insert tube, and first and second insert tubes confining an annular space for collecting oily matter, the second insert tube having a portion extending out of the top tube and an annular flange to rest on the top end of the top tube, the telescopic section of the connecting tube means being resting on the annular flange.

The present exemplary preferred embodiment will be described in detail with reference to the accompanying drawings, in which:

DETAILED DESCRIPTION OF THE PREFERRED EMBODIMENT

Figure 1:
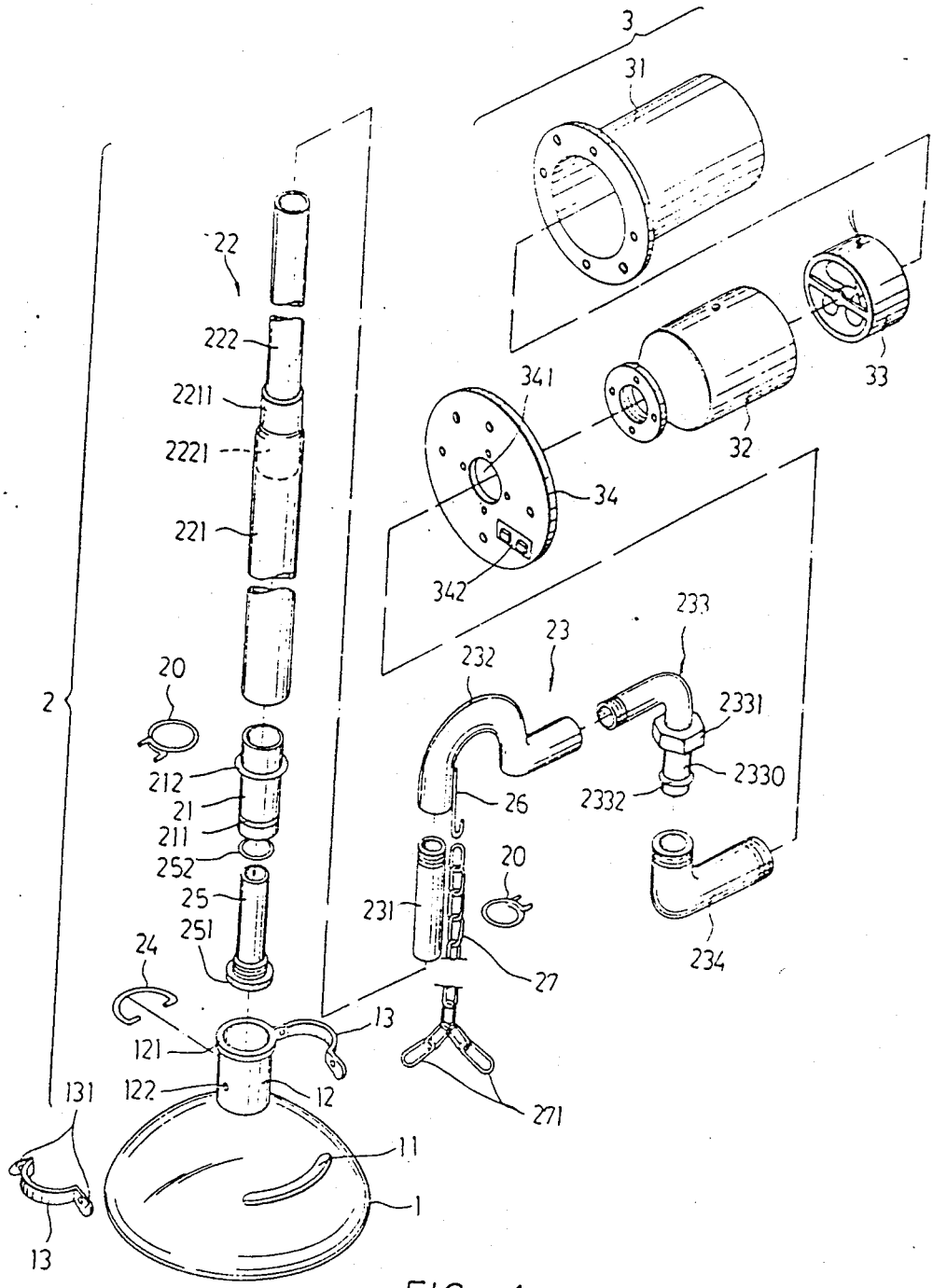
FIG. 1 is an exploded view of a kitchen exhaust device according to the present invention.
Figure 2:
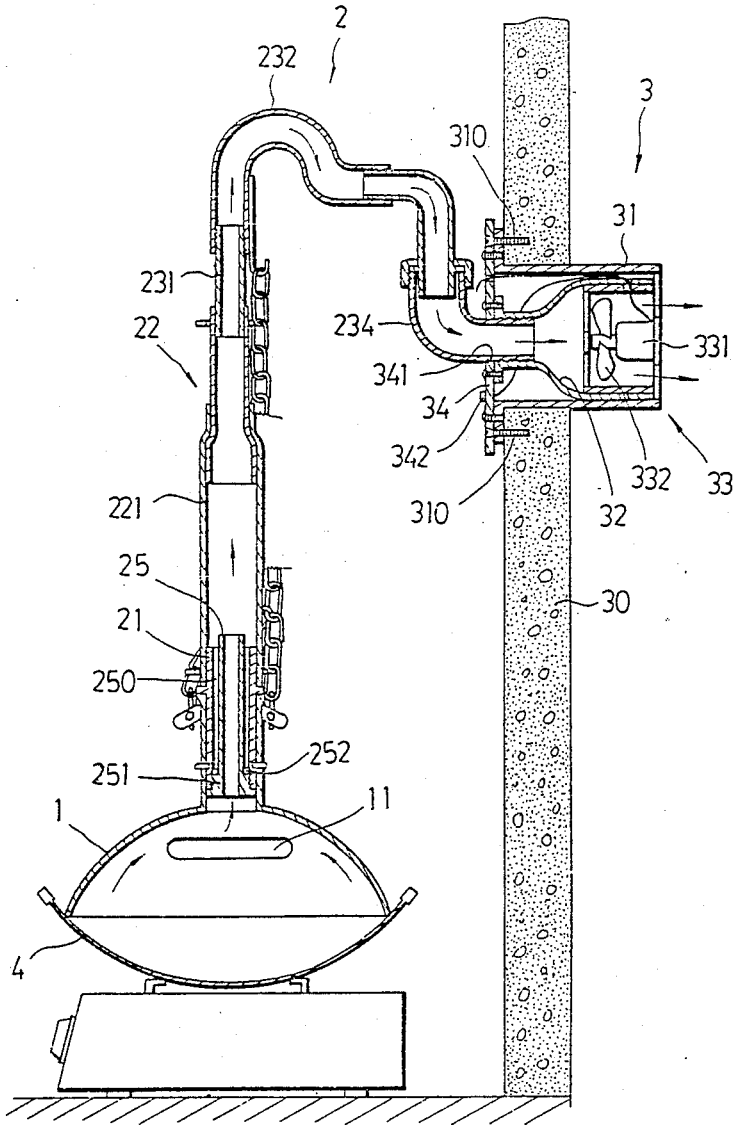
FIG. 2 is a sectional view of the exhaust device of FIG. 1 in a lowered position.

Referring to the drawings, a device of the present invention is shown, including a cover 1, a tubular connecting means 2 and a smoke exhausting means 3. The cover 1 is in the form of a hood for a cooking unit and is provided with an oblong slot 11. At the top of the cover is protruded a top joint tube 12 which has a flange 121 and two diametrically opposite holes 122.

The connecting means 2 includes a tube 21 inserted into the top joint tube 12. The tube 21 has an annular flange 212 which rests on the top edge of the joint tube 12. The upper part of the tube 21 is connected to a telescopic second tube section 22 whose lower end is sleeved on the tube 21 and rests on the flange 212. A clamp ring 20 is provided around the lower end of the telescopic tube section 22 to clamp it against the joint member 12. The upper end of the telescopic tube section 22 is connected to a third tube section 23 by means of another clamp ring 20.

The tube 21 further has an annular groove 211 which is aligned with the holes 122 of the joint tube 12. Two ends of a substantially C-shaped locking member 24 are inserted into the holes 122 and engaged with the groove 211, thereby securing the tube 21 to the top tube 12.

An insert tube 25 is provided within the tube 21. The insert tube 25 is provided with a threaded enlarged portion 251 which is fitted snugly in the joint tube 12 adjacent to the top opening of the cover 1 and engaged with the threaded bottom portion of the tube 21. The walls of the tube 21 and of the insert tube 25 confine an annular space 250 for collecting oily substances created in the connecting tube means 2. A sealing ring 252 is provided in the annular space 250. The telescopic tube section 22 comprises an outer tube 221 and two inner tubes 222 and 231, wherein the outer tube 221 has a restricted top end 2211. The inner tube 222 overlaps with and extends in the outer tube and has an enlarged end 2221 to prevent the inner tube releasing from the outer tube 221. The tube 231 is telescopically connected to the tube 222. A clamp ring 20 is provided around the tube 222 so as to clamp or lock the tube 222 to the tube 231 at a desired location.

The third tube section 23 is connected to the tube 231 of the telescopic tube section 22. The third tube section includes a curved tube 232 connected to the connector tube 231, and an angled tube 233 connected to the curved tube 232 as well as to another angled tube 234.

The angled tube 232 is further provided with a nut 2331 and an annular flange 2332 to prevent the nut from moving downward. The upper threaded end of the angled tube 234 is engaged with the nut, thereby being connected to the angled tube 233. Since the nut 2331 is turnable, the angled tube 233 can be turned relative to the angled tube 234.

An exhausting means 3 includes a housing 31 which can be installed in a hole created for that purpose in a wall. The housing 31 has a front flange screwed to a mounting plate 34. The mounting plate 34 is attached to the wall by means of screws. The mounting plate 34 has an opening to allow the angled tube 234 to enter the housing 31.

A fan casing 33 is positioned in the housing 31. The casing has a rear side opened to the exterior of the wall and a front opening in communication with a guide conduit 32 which in turn is screwed to the angled tube 234. A fan blade assembly 332 is connected to a motor 331 which is provided in the fan casing 33. To control the operation of the motor, switches 342 are provided on the mounting plate 34.

In order to improve the hanging capability of the device of the invention, a hanging chain 27 is incorporated in the device. A hook 26 is attached to the curved tube 232 for hanging one end of the chain 27. The other end thereof has two branches 271 which are connected to a clamp member 13 which is attached to the joint portion 12 of the cover 1.

In operation, the cover 1 may be placed in a position covering a cooking unit as shown in FIG. 1. When the cover 1 is used as a hood of the cooking unit, the oblong opening 11 serves as an access to the cooking unit and premits a slice or the like to pass therethrough. In this case, the hood is preferably made of a transparent material so that the user can see the inside of the cover 1.

Figure 3:
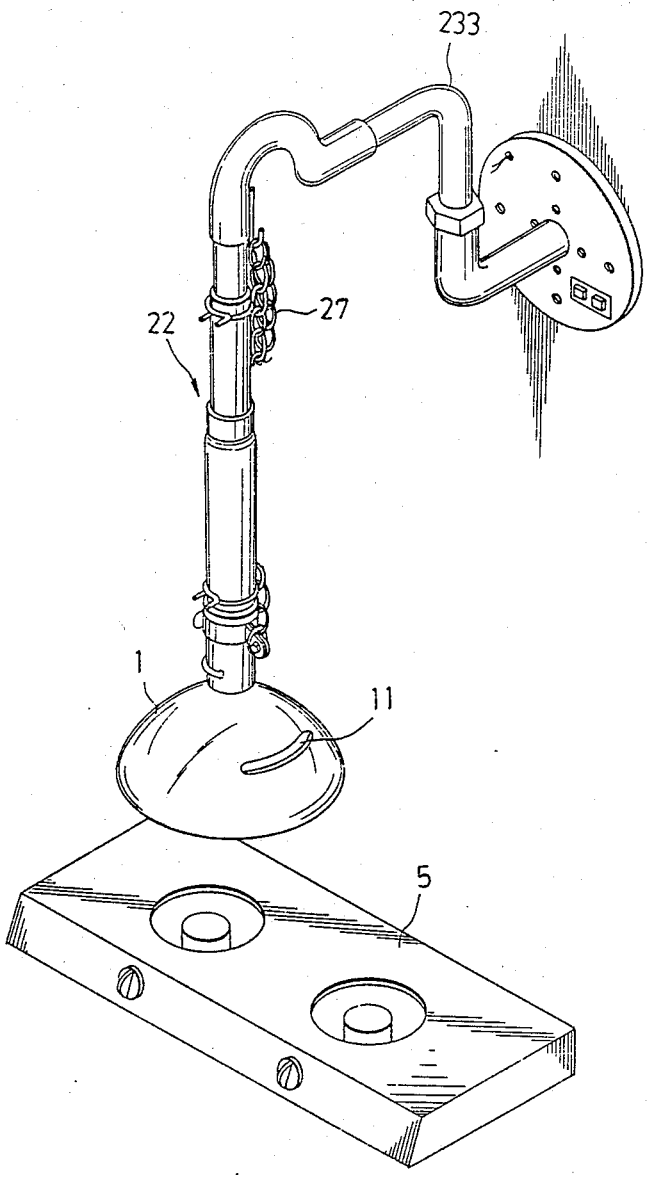
FIG. 3 is a perspective view of the exhaust device of FIG. 1 in a raised position.

Referring to FIG. 3, the cover 1 can also be placed at a level higher than the cooking unit during application. In this situation, the device of the invention is also effective for drawing the smoke and the vaporized oily substances from the cooling unit. The blong opening 11 of the cover may direct the surrounding smoke to be sucked into the cover 1.

Although the exhaust device of the present invention is effective for removing kitchen smoke, some oily substances will, of course, remain on the wall of the tubes. In order to prevent these oily substances from leaking through the joint between the top tube 12 and the tube 21, the annular space 250 around the insert tube 25 is used for collecting the oily matter. To clean out the undesirable oily matter, the tubes 21 and 25 can be removed from the cover 1 by detaching the clamping ring 20 and the locking member 24. The curved tube 232 which is lowered at its downstream portion can prevent reverse flow of the oily matter collected in the curved tube 232. It can be appreciated that the exhaust device of the invention saves energy more effectively than the conventional exhaust device for use in the kitchen.

With the invention thus explained, it is apparent that numerous modifications and variations can be made without departing from the scope of the invention. It is therefore intended that the invention be limited only as indicated in the appended claims.

What I claim is:

1. A kitchen exhaust device comprising:

a fan unit to be mounted on a wall, having a fan casing with a suction side and a discharging side, and a guide conduit provided at said suction side, a cover means to lie above a cooking unit, having a top opening and a top tube extending from said top opening;

a connecting tube means having a first end communicated with said top tube of said cover means and a second end communicated with said guide conduit, said tube means having a bent section connected to said guide conduit, a telescopic section extending downward from said bent section and connected to said cover for adjusting the level of said cover above the cooking unit, and a locking means for locking the telescopic section after adjustment; and means for collecting oily substances removably placed in said top tube of said cover, said means including an oil collecting tube means inserted into said top tube and having an annulus-shaped cavity for receiving oily substances.

2. A kitchen exhaust device as claimed in claim 1, wherein said oil collecting tube means includes a first insert tube inserted into said top tube, which has a threaded enlarged lower end fitted snugly in said top tube adjacent said top opening, a second insert tube inserted into said top tube around said first insert tube and having a threaded end engaging with said threaded enlarged lower end of said first insert tube, said first and second insert tubes confining an annular space for collecting oily matter, and means for holding said first and second insert tubes in said top tube.

3. A kitchen exhaust device as claimed in claim 2, wherein said second insert tube has a portion extending into said top tube and the remaining portion extending into said telescopic tube section from said top tube and an annular flange interposed between the ends of said top tube and said telescopic tube section.

4. A kitchen exhaust device as claimed in claim 3, wherein said cover is in the form of a hood of a cooking container, said hood having an elongated access aperture.

5. A kitchen exhaust device as claimed in claim 3, further comprising a chain mounted for hanging said cover on said connecting tube means.

6. A kitchen exhaust device as claimed in claim 3, wherein said fan unit further includes a housing covering said fan casing, said housing having a mounting flange to be attached to the wall.

* * * * *